US006588987B1

(12) United States Patent
Degen et al.

(10) Patent No.: US 6,588,987 B1
(45) Date of Patent: Jul. 8, 2003

(54) DEVICE FOR INSERTING FOREIGN MATTER INTO THE SOIL OR FOR COMPACTING THE SOIL

(75) Inventors: Wilhelm Degen, Reichenburg (CH); Alexander Degen, Schwindegg (DE)

(73) Assignee: Vibroflotation B.V., Niederlande ( * ) Notice: Subject to any disclaimer, the term of this patent is extended or adjusted under 35 U.S.C. 154(b) by 0 days.

(21) Appl. No.: 09/647,403

(22) PCT Filed: Mar. 30, 1999

(86) PCT No.: PCT/EP99/02170

§ 371 (c)(1),
(2), (4) Date: Nov. 30, 2000

(87) PCT Pub. No.: WO99/50506

PCT Pub. Date: Oct. 7, 1999

(30) Foreign Application Priority Data

Mar. 30, 1998 (DE) ..... 198 14 021

(51) Int. Cl.[7] ..... E02D 3/02
(52) U.S. Cl. ..... 405/271; 404/133.2
(58) Field of Search ..... 405/271, 302.5, 405/231, 232, 233, 235; 404/133.05, 133.2

(56) References Cited

U.S. PATENT DOCUMENTS

| | | | | | |
|---|---|---|---|---|---|
| 3,720,063 | A | * | 3/1973 | Shono | 405/50 |
| 3,772,892 | A | * | 11/1973 | Ogawa | 405/271 |
| 3,909,149 | A | * | 9/1975 | Century | 404/133.2 |
| 4,280,770 | A | * | 7/1981 | Woodruff | 405/271 |
| 4,698,926 | A | * | 10/1987 | Caplis et al. | 404/133.2 |
| 4,730,954 | A | * | 3/1988 | Sliwinski et al. | 405/240 |
| 4,910,673 | A | | 3/1990 | Narisawa et al. | |
| 5,279,502 | A | * | 1/1994 | Goughnour | 405/237 |
| 5,328,299 | A | * | 7/1994 | Degen et al. | 405/240 |
| 5,441,366 | A | | 8/1995 | Esters | |
| 5,797,705 | A | | 8/1998 | Kellner | |

* cited by examiner

*Primary Examiner*—Heather Shackelford
*Assistant Examiner*—Frederick Lyndon Lagman
(74) *Attorney, Agent, or Firm*—Pendorf & Cutliff

(57) ABSTRACT

Device for inserting foreign matters into the soil and/or for compacting the soil, comprising a countersinking unit (22) with a depth vibrator, that is coupled to an articulated arm, in addition to a control device through which the articulated arms (2, 3, 4) can be controlled in such a way that the countersinking unit can be displaced linearly in a predetermined direction along its longitudinal extension.

11 Claims, 3 Drawing Sheets

DEVICE FOR INSERTING FOREIGN MATTER INTO THE SOIL OR FOR COMPACTING THE SOIL

BACKGROUND OF THE INVENTION

1. Field of the Invention

The invention concerns a device for introducing a foreign material into the ground or for compacting the ground with a depth vibrator as the primary tool.

2. Description of the Related Art

In work involving a deep vibrator, one employs at the present time the "free riding method", that is, the vibrator is attached to a strip shovel or cable excavator or the like cable lift device via a cable pulley or a hook or the Maekler guide (framework or rigging).

Besides this, three or more part carrier mechanisms (arms or booms) are known from pile drivers (Dectilepile, FIG. 4.16, construction handbook, $4^{th}$ edition, page 64, Ernst & Sohn publishers). However, these have until now not been used in combination with deep vibrators.

The Maekler (framework or rigging) guide has, in contrast to the free riding method, the advantage of the limitation of the degree of freedom or displaceability of the vibrating unit to a pre-determined preferably vertical line, so that foreign objects (for example, piles, gravel, columns, drains) can be constructed with the desired verticality. Objects with a pre-determined tilt out of the vertical can absolutely not be constructed with the free riding system.

Particularly in the production of vibration cement piles or gravel vibration columns (so called vibration stamping compacting) the problem has however occurred with the conventional Maekler guide, that the lower stop point of the guide cannot be used or can only rarely be used, since the tortional forces occurring due to the unidirectional insertion or setting into the ground during the sinking process in combination with the also occurring vibrations have led to unacceptable damage in the work and carrier mechanisms. By using only the upper stop point of the Maekler, a so called vibration bead or track, there is in practice intentionally all necessary degrees of freedom of deflection from the vertical penetration direction permitted during the entry or penetration by the vibrator, in order to avoid damage to the device. As a result, the criteria of verticality of the material columns in the ground is however at least partially compromised.

In the likewise conventional method of lowering self-sinking work devices into the ground, such as for example deep vibrators, free-hanging from a cable pulley or similar device, a manual follow-up guiding or resetting is perhaps possible, however, due to the free or loose cable guide this is not definable and cannot be automated.

The Maekler guide makes it possible to apply pull devices not only in the upwards direction, but rather, with the aid of a vertical capstan guide to have a double acting cable acting on the Maekler sled, and so to exercise pull forces downwards on the vibrator. These forces, acting in addition to the weight, significantly supplement the penetration of the vibrator into the ground and substantially accelerate the work progress, or in certain cases, make it possible for the first time to achieve the desired depth.

The free riding method has the advantage, that the high freedom of movement of the vibrating unit on the cable makes possible a very rapid movement between the work points, since in comparison to the Maekler device, it is necessary only to pivot the boom, not however to move the entire device.

Working in the water from embankments or from pontoons, the free riding method is economically superior to the Maekler method, since supplementary rigging and special constructions can be dispensed with. Also, in the case of soft construction ground having insufficient carrying capacity for the heavier tractor or caterpillar of the Maekler vehicle (usually a type of pile driver), the free riding method is advantageous, or employment of the Maekler guide may not even be possible. Frequently, the ground or soil particularly in the vicinity of the vibration point is softened, and the load-bearing capacity is reduced.

This is precisely the point of the greatest application of force of the carrier or tractor of the Maekler.

As rental devices the earth construction machines using the free riding methods (primarily cable pulleys, or as the case may be auto cranes) are more economical and easier to obtain than in the case of the special rigging required for the Maekler method.

As the state of the art, further reference is made to the following publications:

DE 22 60 473 C3 describes a device for producing material columns in the ground, in which a deep vibrator is provided on a cantilever beam of a lifting device via a rod.

For compacting the ground, a device is known from U.S. Pat. No. 4,280,770, in which a tube or pipe-like vibration unit on its upper end is connected to a boom of a dredge or excavating machine, and is applied to the ground via the boom. By vibration of the vibration unit, this sinks into the ground with compacting of the soil and is subsequently withdrawn and moved to the next position. In contrast to deep vibration, no change in direction of the vibration unit along a pre-determined direction is necessary, thus the corresponding means therefore are not provided.

From DE-GM 72 27 703 a trench compactor is known with a submersible or penetrating vibrator provided on the lower end of a rod or beam. The rod is provided on a boom of a hydraulic dredge, which urges the vibrator at a target point into the ground. The submersible vibrator remains stationary in the ground during the compacting process and after conclusion of the compacting process is again withdrawn from the ground. In comparison to deep vibrators, a moveability of the submersible vibrators plays no role, and thus means therefore are not provided.

SUMMARY OF THE INVENTION

It is the task of the present invention to provide a device for introduction of a foreign substance into the ground and/or for compacting the ground, which does not exhibit the above-mentioned disadvantages.

In accordance therewith, the device includes a penetrating unit including a deep vibrator which is coupled to an articulated arm or boom, wherein a control device is provided, by means of which the articulated arm or boom is controllable in such a manner, that the penetrating unit is guidable linearly in a predetermined direction along its longitudinal direction.

The provision of the penetrating unit on the articulated arms makes possible, in comparison to the devices based on the free riding method, the desired limitation of the degree of freedom during a movement of the penetrating unit. On the other hand, the provision of the penetrating unit on the articulated arms makes possible more freedom of movement in so far as it is desired that the penetrating unit, taking advantage of the moveability of the articulated arms, can be applied to various adjacent entry points in the ground without the need to move the earth construction machine carrying the articulated arm, as has been necessary in the case of devices which function in accordance with the Maekler method.

A linear introduction of the penetrating unit into the ground perpendicularly or at any almost freely selectable angle is made possible by a control unit. The arm is controlled by the control unit in such a manner, that the penetration unit in its longitudinal direction can be introduced linearly into the ground for production of a material column, without producing any transverse forces between the penetrating unit and the wall of the opening which already exists, or which is produced by the introduction of the penetrating unit, during the introduction or the pulling out of the penetrating unit.

BRIEF DESCRIPTION OF THE DRAWINGS

According to one embodiment of the invention, it is envisioned to provide a tilt sensor in the penetrating unit. Sensor signals of the tilt sensor can be communicated to the control unit of the articulated arm, in order to correct the articulated arm when the direction of movement of the penetrating unit deviates from a predetermined direction.

Preferably the penetrating unit is connected to the arm via a connecting piece wherein the connecting piece includes at least one force sensor for determining the perpendicular forces between the connecting piece and the penetrating unit. This type of perpendicular force or transverse force is produced for example when the articulating arm is moved for correction in the case of a deviation of the penetrating unit from the predetermined direction. If the perpendicular forces on the connecting piece exceed a maximal acceptable value, damage to the connecting piece or the arm can occur. Sensor signals of the at least one force sensor are communicated to the control unit of the arm, in order to interrupt the correction movement of the arm, when a damaging of the arm on the basis of the transverse forces occurring cannot be ruled out.

According to a further embodiment, it is envisioned to provide an elastic connecting piece between the connecting piece and the penetrating unit and/or between the connecting piece and the arm. Thereby the forces transmitted from the penetrating unit to the arm are reduced.

The articulating arm includes a number of members, through which upon control by the control unit a linear movement of the penetrating unit occurs. Preferably at least one of these members exhibits a telescoping mechanism, in order to produce a variable length of this member. These variations make possible an increase in the number of entry points of the penetrating unit without movement of arm-carrying earth construction machine.

According to a further embodiment of the invention, it is envisioned to construct an extension tube of the penetrating unit, which preferably connects upwardly onto the deep vibrator, to be variable in its length. The change in length preferably occurs by means of a telescoping mechanism and makes possible the working of the earth in greater depths. The maximal possible length of the penetrating unit during penetration into the ground is limited by the booms, on which the penetrating unit is secured. After the penetrating unit according to the described embodiment with extension pipe is introduced in the ground, its length can be increased by extending the extension pipe, in order to make possible a working of the ground at greater depths.

It is further envisioned to provide on the arm multiple penetrating units, in particular in triangular, star-shaped, or quadratic arrangement. Thereby it is possible in a single work process simultaneously to produce a corresponding number of material columns in the ground.

Figure 1A:
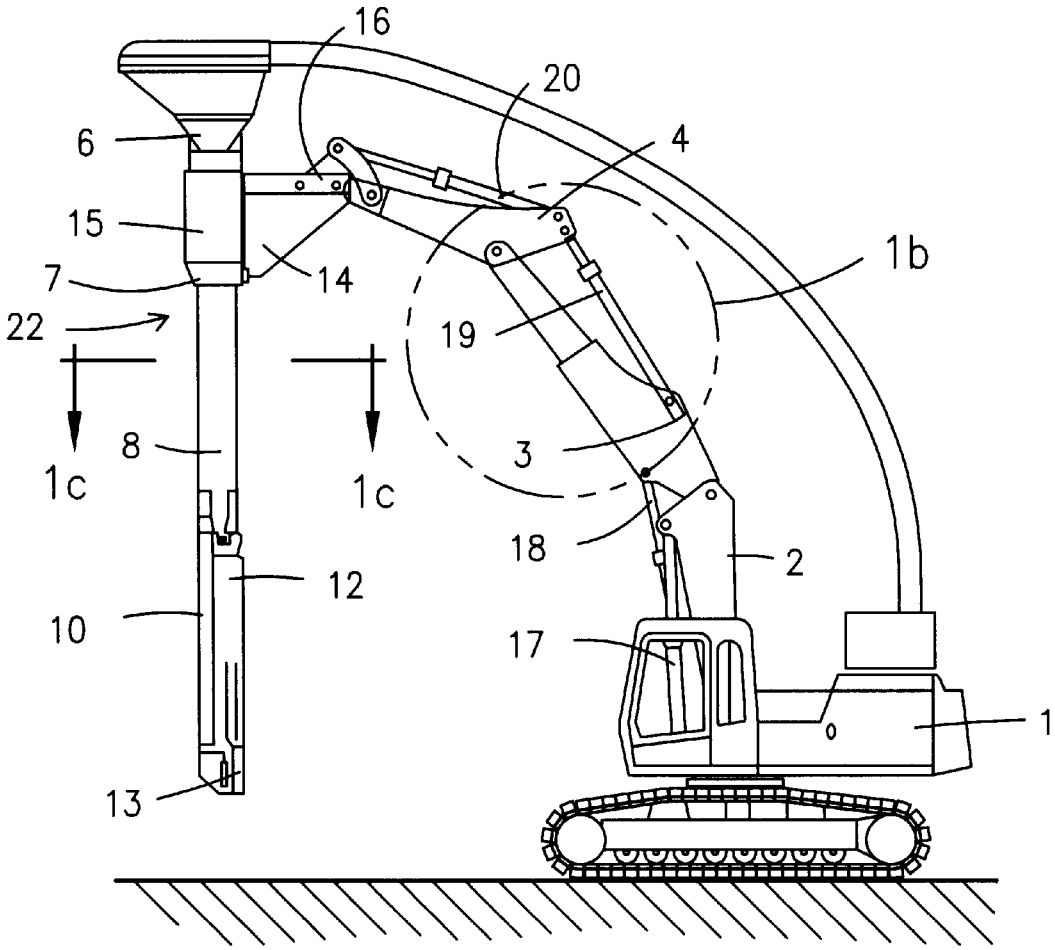
Figure 1B:
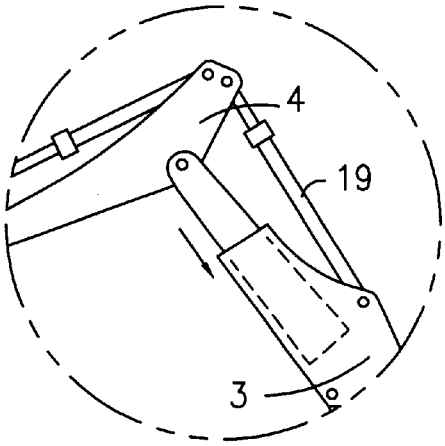
Figure 1C:
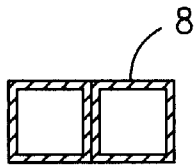

The invention is described in greater detail in the following on the basis of embodiments shown in the figures. There is shown:

FIG. 1*a*: Embodiment of an inventive device for the introduction of a penetrating unit in the ground;

FIG. 1*b*: is an enlargement view of the arm according to the present invention showing a telescoping mechanism;

FIG. 1*c*: is a cross sectional view of the device according to the present invention taken along lines 1*c*–1*c* of FIG. 1*a*which shows two penetration units.

Figure 2:
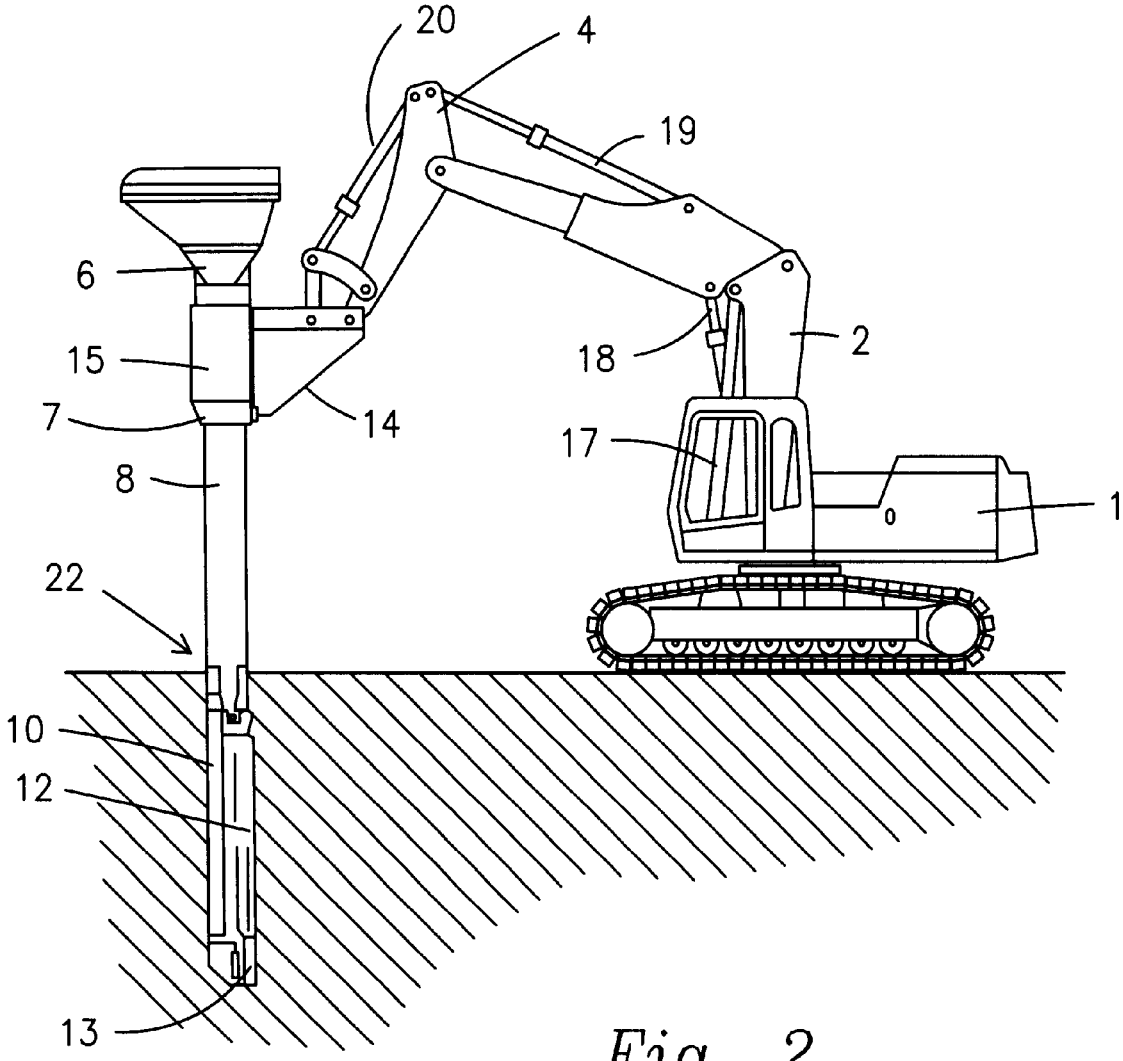
Figure 3:
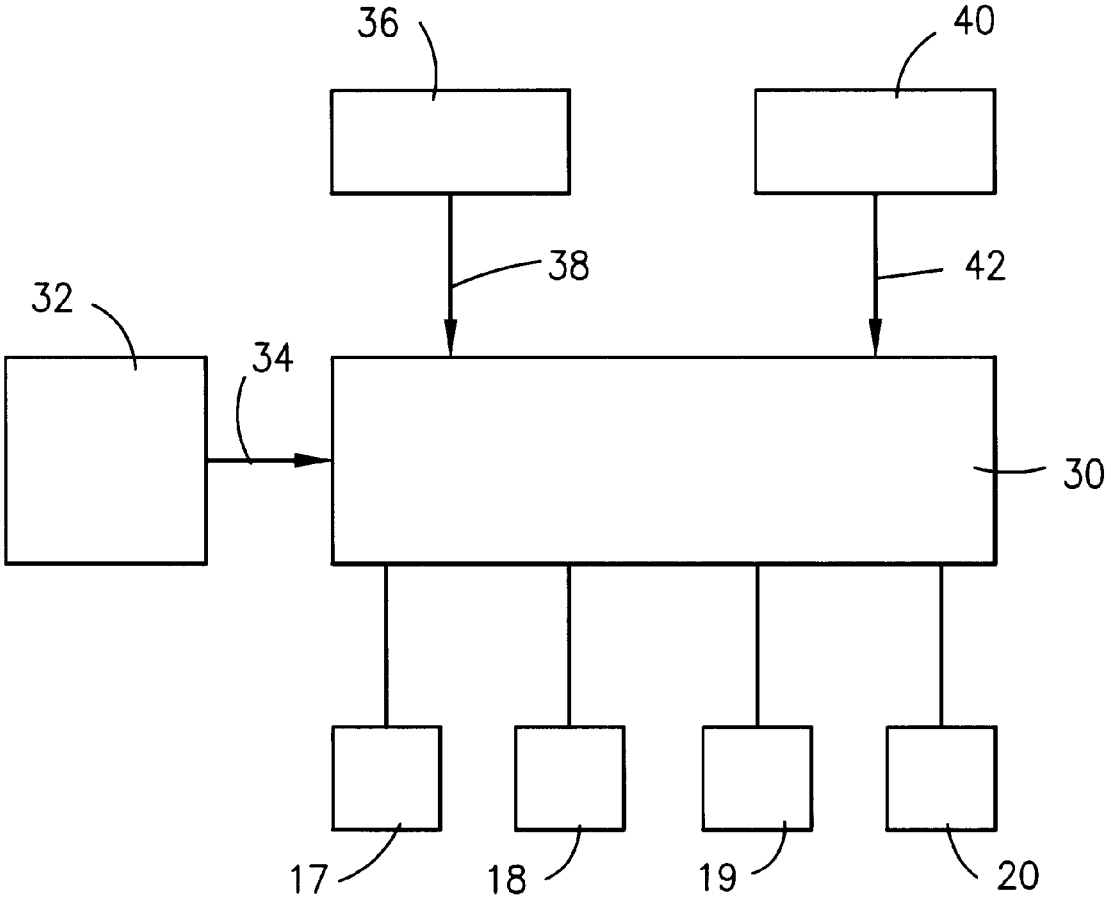

FIG. 2: Embodiment of the inventive device according to FIG. 1 with penetrating unit introduced into the ground;

FIG. 3: Block schematic diagram of a control unit of the device in accordance with the invention.

DETAILED DESCRIPTION OF THE INVENTION

In the figures, the same reference numbers refer to the same parts with the same meaning, unless otherwise indicated.

FIGS. 1 and 2 shown an inventive device for introduction of a foreign material into the ground, in particular for production of material columns in the ground, or for compacting the ground. The device includes a penetrating unit 22, which by means of a connecting piece 14 is provided on an arm or boom comprised of three carrier members 2, 3, 4 of a mobile construction machine 1. The carrier members 2, 3, 4 are linked to each other for articulation and are respectively moveable about these links via hydraulic control cylinders 17, 18, 19. A further link 16 is provided between the forward-most carrying member 4 and the connecting piece 14, whereby the connecting piece 14 is moveable with respect to the foremost carrying member 4 by means of a further hydraulic cylinder 20.

For production of material columns or, as the case may be, compacting of the ground, the penetrating unit, as shown in FIG. 2, is introduced into the ground. Thereby it is indispensible that the penetrating unit 22 both during introduction in the ground as well as during subsequent withdrawal is moved only linearly in its longitudinal direction, in order on the one hand to produce a straight material column, and on the other hand, to minimize transverse forces, which occur between the walls of the opening and the penetrating unit 22 when the penetrating unit 22 is subjected to a bending load as a result of a non-linear movement. These transverse forces would lead in particular to transverse forces between the penetrating unit 22 and the connecting piece 14 or, as the case may be, the connecting piece 14 and the arm 2, 3, 4 and can lead to damage.

For bringing about a straight movement of the penetrating unit 22, a control unit for controlling the hydraulic positioning cylinders 17, 18, 19, 20 is provided, which dictates the stroke progress of the adjusting cylinders 17, 18, 19, 20 with respect to each other during lifting and lowering of the penetrating device 22, so that the penetrating unit 22 maintains a predetermined angle with respect to the vertical or the ground surface and is not subject to any horizontal movement. Thereby it is insured that the friction is minimized between the penetrating device 22 and the ground both during introduction in the ground as well also during withdrawal, and the penetrating device 22 is also not subjected to bending forces. During lifting and lowering of the penetrating unit 22, the angle of the connecting piece 14 with respect to the front carrying member 4 is so adjusted by the cylinder 20 via the linkage 16, that the penetrating unit maintains a predetermined angle with respect to the vertical or the perpendicular. The carrier members 2, 3, 4 are so adjusted by the position cylinders 17, 18, 19, that the entry point of the penetrating unit 22 in the ground during lifting and lowering remains unaltered.

The penetrating device 22 exhibits on its upper end an inlet funnel for filling of the material to be introduced into the ground. The material enters via a first lock 6 into a charge chamber 15 and from there via a second lock 7 and via a material conveyor pipe 10 to the point of introduction of the material at the tip of the penetrating device 22. In the lower area of the penetrating device, there is a deep vibrator 12 with a vibrating tip 13, in which the material conveyor pipe 12 for the material outlet is in communication. The discharged material is compacted by the deep vibrator 12, whereby the penetrating unit 22, as the material deposit in the opening increases, is raised by the arm 2, 3, 4 and leaves behind a compacted material column. The orientation of the material column corresponds to the orientation of the penetrating unit 22 introduced into the ground. Besides vertical columns, it is possible by means of the inventive device to produce columns with almost any desired angle relative to the ground surface.

Between the deep vibrator 12 and the charge chamber 15, an extension pipe 8 is provided, which is preferably variable in its length. The lengthening adjustment occurs, for example, by means of a telescoping mechanism. The penetrating unit 22 cannot, during introduction in the ground, exceed a maximal length, which is predetermined by the length of the arm 2, 3, 4, in order to make possible a vertical introduction in the ground. The described embodiment makes possible the shortening of the extension pipe 8, in order to make possible an introduction into the ground, and the extension pipe 8 is then lengthened with increasing work depth.

Preferably at least one of carrying members 2, 3, 4 are variable in their length, which makes possible the employment of a longer penetration unit 22 and therewith makes possible penetration into greater depths.

For monitoring the penetration into and withdrawal of the penetration unit 22 out of the ground there is preferably provided a tilt sensor in the vibration unit 13, which detects tilt of the penetration unit 22 with respect to the horizontal or vertical and which provides a sensor signal which is supplied to the control unit of the articulated members 2, 3, 4. If the degree of tilt of the penetrating unit deviates from the predetermined tilt, then the articulated members 2, 3, 4 are adjusted in order to maintain the predetermined tilt.

The connecting piece 14 between the penetrating unit 22 and the articulated members 2, 3, 4 is preferably vibration dampening and exhibits at least one force sensor for determining the torsional forces and/or transverse forces acting on the connection between the connecting piece 14 and the articulated members 2, 3, 4. If the penetrating unit 22, during introduction in the ground, deviates from the predetermined direction, then the articulating arm 22 is corrected in a direction perpendicular to the entry direction so long until the desired penetration direction is adjusted. Thereby, the penetrating unit 22 is subjected to a bending load or force, which brings about torsional forces on the connecting piece 14 or transverse forces acting perpendicular to the connecting surface of the connecting piece 14 and the penetrating unit 22. These forces, which can lead to a damaging of the connection or the articulated arm 2, 3, 4, are detected by the force sensors. The sensor signals provided by the force sensors are supplied to the control unit of the articulated arm 2, 3, 4, whereby the sensor signals during the movement of the articulated arm 2, 3, 4 are taken into consideration, and wherein the articulated arm 2, 3, 4 is subjected to correction for correcting the penetration direction only so long as the forces occurring are below an acceptable maximal value. If the occurring urging forces exceed the acceptable value, the penetration process is interrupted. The deviation of the penetration unit 22 from the ideal line can result from an impediment occurring in the ground, which may necessitate a renewed penetration process at an adjacent position.

Besides monitoring the forces occurring during the directional correction of the arm 2, 3, 4 the sensor signals produced by the force sensors can also be utilized to continue the correction until the occurring transverse forces in a direction perpendicular to the desired movement direction of the penetration unit 22 fall below a predetermined value. By the avoidance of a too-large transverse force, a damaging of the connection between arm 2, 3, 4 and penetrating unit 22, in particular in the area of the linkage 16, through which the force is transmitted from the connecting piece 14 to the arm 22, is prevented. The transverse forces can occur, for example, from obstacles or impediments in the ground, which impede the penetration of the penetrating unit 22 along a desired ideal line.

For optimal detection of the forces multiple force sensors are provided in circular manner about the penetrating unit 22 in the area of the connecting piece 14.

FIG. 3 shows an example of a block diagram for illustrating the control of the articulated arm 2, 3, 4 for introduction of the penetrating unit 22 into the ground and for withdrawing out of the ground, in accordance with which the penetrating unit 22 can be positioned over the desired penetration point. A control unit 30 acts on hydraulic control cylinders 17, 18, 19, 20 for movement of the articulated arm 2, 3, 4. The control of the control cylinders 17, 18, 19, 20 occurs according to a control signal 34, which is provided by an operating unit 32 and which signals whether a forward or retreating movement or no movement of the penetration unit 22 is to occur. An operating unit 32 can thereby be an operating lever as conventional in dredges or excavators. Taking into consideration the instantaneous position of the control cylinders 17, 18, 19, 20, these are so controlled relative to each other, that the penetration unit 22 is driven linearly in its longitudinal direction. An angle at which the penetration unit 22 is to penetrate into the ground is taken into consideration during the control of the control cylinders 17, 18, 19, 20. In the illustrative embodiment, besides the control signal 34, a sensor signal 38 of a tilt sensor 36 of the vibration unit 13 and a sensor signal 42 of at least one force sensor 40 provided in the area of the connecting piece 14 are taken into consideration. If the sensor signal 38 indicates that the penetration unit 22 is deviating from the predetermined penetration direction, then the cylinders 17, 18, 19, 20 are so controlled that the articulated arm 2, 3, 4 is corrected perpendicularly to the penetration direction. Therein the forces occurring between the connecting piece 14 and the penetration unit 22 are monitored, and the penetration process or, as the case may be, a further movement of the control cylinders is interrupted, when the sensor signal 42 signals the presence of forces which are too large.

The control or, as the case may be, regulation, of the movement of the articulated arm 2, 3, 4 dependent upon the urging forces during follow-up correction of the penetration direction is also important in order to prevent that the elongation pipe 8 is loaded or stressed beyond its bend limitation.

The inventive device makes possible a rational and, in comparison to the hitherto conventional devices, an economical and rational processes for introduction of foreign materials in the ground or for compacting the ground. The use of a moveable hydraulic dredge or excavator 1, on the arm 2, 3, 4 of which the penetration unit 22 is provided, makes possible in rational matter sequential work processes in varying positions. Since the hydraulic dredge or excavator 1 is provided with a rotating track or turntable or ring mount and the arm is pivotable sideways, for example, by a flexible link mounting, material columns can be introduced in adjacent positions in the ground without requiring movement of the dredge or excavator 1. The rigid arm 2, 3, 4 besides this prevents a swinging or pendulation of the penetration unit 22 during introduction in the ground.

REFERENCE NUMBER LIST

| | |
|---|---|
| 1 | Mobile construction machine |
| 2 | Lower member of the carrier mechanism of the arm |
| 3 | Middle member of the carrier mechanism of the arm |
| 4 | Upper member of the carrier mechanism of the arm |
| 6 | Upper lock |
| 7 | Lower lock |
| 8 | Elongation pipe |
| 10 | Material conveyance pipe |
| 12 | Work device (deep vibrator) |
| 13 | Vibrator tip (material outlet) |
| 14 | Connecting piece |
| 15 | Charge chamber |
| 16 | Linkage |
| 17 | Lower control cylinder |
| 18 | Central control cylinder |
| 19 | Upper control cylinder |
| 20 | Control cylinder for linkage |
| 22 | Penetration unit |
| 30 | Control device |
| 32 | Operation element |
| 34 | Control signal |
| 36 | Tilt sensor |
| 38 | Sensor signal |
| 40 | Force receiver |
| 42 | Sensor signal |

What is claimed is:

1. A device for introducing foreign substances into the ground or for compacting the ground, said device comprising:

a penetration unit (22) having a deep vibrator, an articulated arm (2, 3, 4) to which said penetration unit is connected via a connecting piece (14), said articulated arm including at least one foremost member (4) and at least one rearmost member, wherein the connecting piece is moveable via a hydraulic cylinder relative to the forwardmost member (4) of the articulated arm, and a control device (30), by means of which the articulated arm (2, 3, 4) and the connecting piece (14) are controllable in such a manner, that the penetration unit (22) can be extended in a predetermined direction linearly in its longitudinal direction.

2. A device according to claim 1, wherein the penetration unit (12) includes at least one tilt sensor (36), wherein a sensor signal (38) of the tilt sensor (36) can be supplied to the control unit (30) of the articulated arm (2, 3, 4).

3. A device according to claim 1, wherein the penetration unit (22) is coupled via a connecting piece (14) to the articulated arm (2, 3, 4) and that in the area of the connecting piece (14) at least one force sensor (40) is provided for detecting at least one of transverse forces or torsional forces between the connecting piece (14) and the penetration unit (22), whereby a sensor signal (42) of the force sensor (40) can be supplied to the control device (30) of the articulated arm (2, 3, 4).

4. A device according to claim 1, wherein the articulated arm (2, 3, 4) includes a number of linkages.

5. A device according to claim 1, wherein an elastic connecting piece is provided between the connecting piece (14) and the penetrating unit (22) and/or between the connecting piece (14) and the articulated arm (2, 3, 4).

6. A device according to claim 1, wherein the penetrating unit (22) includes an extension pipe (8), which preferably telescopingly is variable in length.

7. A device according to claim 1, wherein the articulated arm (2, 3, 4) is a part of a mobile earth construction machine (1), which includes a moveable upper rigging or a rotatable platform.

8. A device according to claim 1, wherein the articulating arm (2, 3, 4) is provided with a number of members (2, 3, 4), of which at least one is variable in length via a telescoping mechanism.

9. A device according to claim 1, wherein the penetration unit (22) includes a material supply means with a hose conveyor arrangement or a conveyor belt arrangement.

10. A device according to claim 1, wherein at least two penetrating units, preferably in triangular, star-shaped, or quadratic arrangement, are coupled to the articulating arm (2, 3, 4), via the connecting piece (14).

11. A method for introduction of a foreign material in the ground or for compacting the ground, said method comprising the step of:

a) obtaining an earth construction machine (1) with an articulating arm (2, 3, 4), b) attaching a penetrating unit (22) having a deep vibrator (12) onto the articulating arm (2, 3, 4), c) urging said penetrating unit linearly into the ground using said articulating arm; and d) controlling step c by using a control unit mounted in the articulated arm, wherein the deep vibrator comprises a tilt sensor, wherein the tilt sensor emits a sensor signal to the control unit in order to correct the articulate arm when movement of the penetrating arm deviate from being linear into the ground.

* * * * *